US005373801A

United States Patent [19]

Spickelmire

[11] Patent Number: 5,373,801

[45] Date of Patent: Dec. 20, 1994

[54] SUBMERGED WEIGHT RETRIEVAL DEVICE

[76] Inventor: W. James Spickelmire, 724 S. "C" St., Grangeville, Id. 83530

[21] Appl. No.: 112,410

[22] Filed: Aug. 26, 1993

[51] Int. Cl.[5] ..... B63B 21/46

[52] U.S. Cl. ..... 114/299; 24/132 R

[58] Field of Search ..... 114/199, 293, 297, 298, 114/299, 221 R; 24/132 R, 134 KA

[56] References Cited

U.S. PATENT DOCUMENTS

| | | | |
|---|---|---|---|
| 337,064 | 3/1886 | Jenkins | 24/132 |
| 591,795 | 10/1897 | Catlin | 114/199 |
| 1,482,268 | 1/1924 | Schopper . | |
| 3,922,990 | 12/1975 | Menard, Jr. | 114/221 R |
| 4,067,287 | 1/1978 | Sabella | 114/299 |
| 4,161,922 | 7/1979 | Fogg | 114/299 |

FOREIGN PATENT DOCUMENTS

| | | |
|---|---|---|
| 0112301 | 6/1984 | European Pat. Off. . |
| 0137886 | 4/1985 | European Pat. Off. . |

*Primary Examiner*—Jesus D. Sotelo

*Attorney, Agent, or Firm*—Wells, St. John, Roberts, Gregory & Matkin

[57] ABSTRACT

A retrieval device is described that facilitates lifting of a submerged weight by action of the forward motion of an associated watercraft connected to the weight by a rope. The rope is releasably attached to the device by a guide member on an elongated rigid frame. A locking member is also provided, to enable sliding movement of the rope in a forward direction, and to grip and hold the rope against rearward motion. Powered motion of the watercraft through the water provides sufficient force to pull the rope forwardly through the device. A top end of the locking member is attached to a net supported flotation device. The flotation device also serves to hold the locking member in an inoperative, open condition during forward motion of the watercraft and forward sliding motion of the rope therethrough. Once the weight is pulled to the vicinity of the device, forward motion of the watercraft is halted. The locking member then functions to prevent the weight from pulling the rope back downwardly. The user is then free to retrieve the free expanse of rope between the watercraft and flotation device without lifting the weight.

14 Claims, 7 Drawing Sheets

SUBMERGED WEIGHT RETRIEVAL DEVICE

TECHNICAL FIELD

The present invention relates to retrieval of submerged weights using a forwardly moving watercraft and a retrieval device attached to a rope connecting the weight and craft.

BACKGROUND OF THE INVENTION

It is a tedious procedure, especially for owners of small watercraft, to retrieve heavy submerged anchor weights. This is especially true in the case of anchors which may have considerable submerged weight. The physical task of raising an anchor, especially in deep water, becomes extremely tiresome.

Mechanical lifts have been known for hoisting anchors. For example the manually operated windlass has been used in ancient times. More recently, power driven winch apparatus have been developed for hoisting submerged weights. However, such apparatus is expensive and bulky, especially for small craft. It therefore becomes desirable to obtain some form of apparatus by which submerged weights may be raised without the tedium, the bulk and expense of independently driven hoisting devices.

Aside from the manual and powered devices mentioned above, flotation hoists also have been devised for raising sunken objects. The prevalent flotation device is an inflatable bladder that is submerged and attached to the sunken weight. The bladder is then inflated to raise the weight to the surface.

The problem with this form of float is that it requires either a diver to set the flotation device, or expensive equipment to set it in place and to effect inflation.

Another flotation device is known that makes use of the power of the associated watercraft. This device includes a float with a depending cord having a ring at one end. The anchor rope is threaded through the ring and is attached to the craft. The float is placed in the water and the craft is moved under power away from the float. Buoyancy of the float and the power of the craft then cooperate to raise the anchor.

This device functions well while the craft is moving. However, once the craft is stopped, the weight will drop back down, with the anchor rope sliding freely through the ring. To retrieve the anchor, then, the operator is forced to pull the rope in while the craft is in motion. The effort required to do this may be as much or more than simply raising the anchor from the bottom with the craft at rest.

Other advancements have included gripping devices that releasably secure the float to the rope once the weight has been lifted. While these devices appear to function well, the rope clamping apparatus is often complex and has a tendency to damage the rope.

An object of the present invention is therefore to provide a simple compact device for lifting submerged weights that have been attached to a watercraft by a rope or similar connector, without requiring significant manual effort.

Another object is to provide such a device that makes use of the motive power source of the watercraft to which the submerged weight is attached for raising the weight.

A still further object is to provide such a device that will raise a submerged weight to the approximate surface of the water, and maintain the weight at the raised position with the rope free to be gathered in without the submerged weight offering resistance.

A yet further object is to provide such a device that may make use of existing flotation devices such as life preservers for providing flotation to lift and buoy the weight.

A still further object is to provide such a device that is very simple in construction and with provisions to avoid damage to the rope when gripped.

These and still further objects and advantages will become apparent upon reading the following description which, taken with the accompanying drawings, describe a preferred form of the invention.

BRIEF DESCRIPTION OF THE DRAWINGS

A preferred embodiment of the present invention is illustrated in the accompanying drawings, in which.

DETAILED DESCRIPTION OF THE PREFERRED EMBODIMENTS

Figure 1:
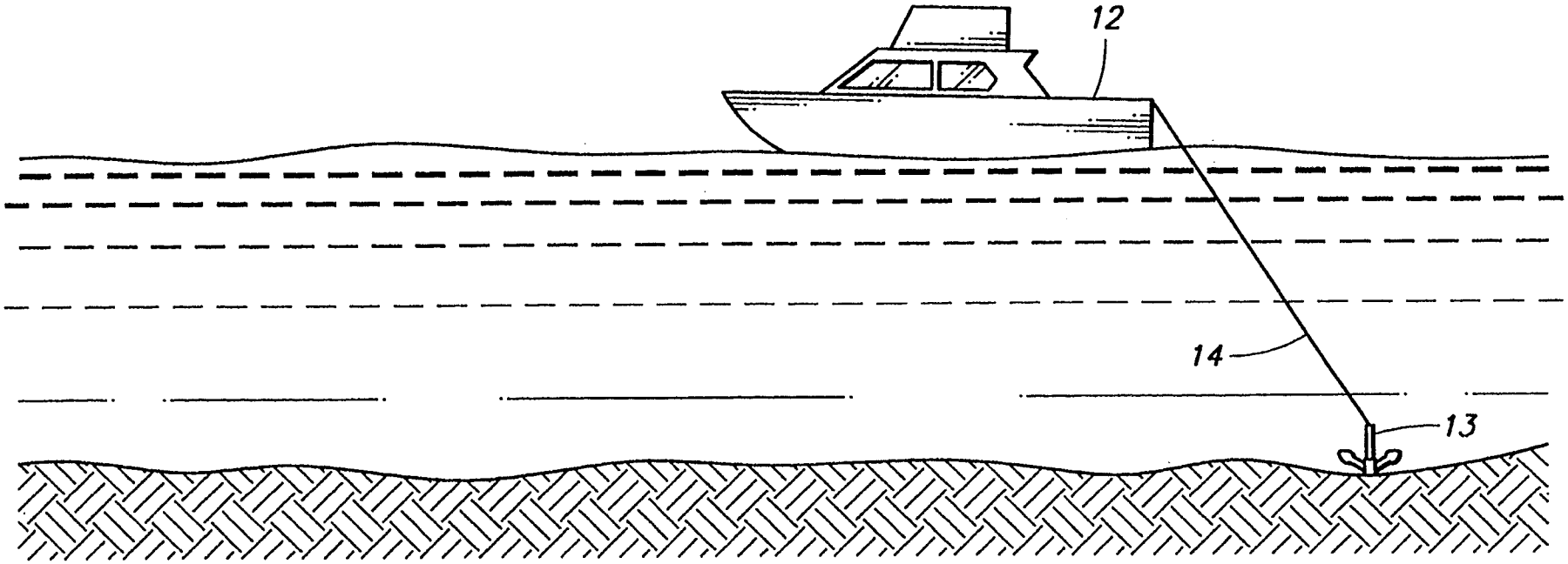
FIGS. 1–3 are sequential operational views, illustrating the use of the present retrieval device for elevating a weight, such as a boat anchor.

The following disclosure of the invention is submitted in furtherance with the constitutional purpose of the Patent Laws "to promote the progress of science and useful arts" (Article 1, Section 8).

A preferred form of the present device is illustrated in the drawings and is designated therein by the reference numeral 10. The present device 10 is intended for use in conjunction with watercraft, such as the small craft at 12 in FIGS. 1–3. The device 10 is useful for elevating a submerged weight 13 that is connected to the watercraft 12 by a rope 14.

It should be understood that the term "rope" as used herein includes other forms of flexible connectors, such as cable, chain, etc.

Figure 2:
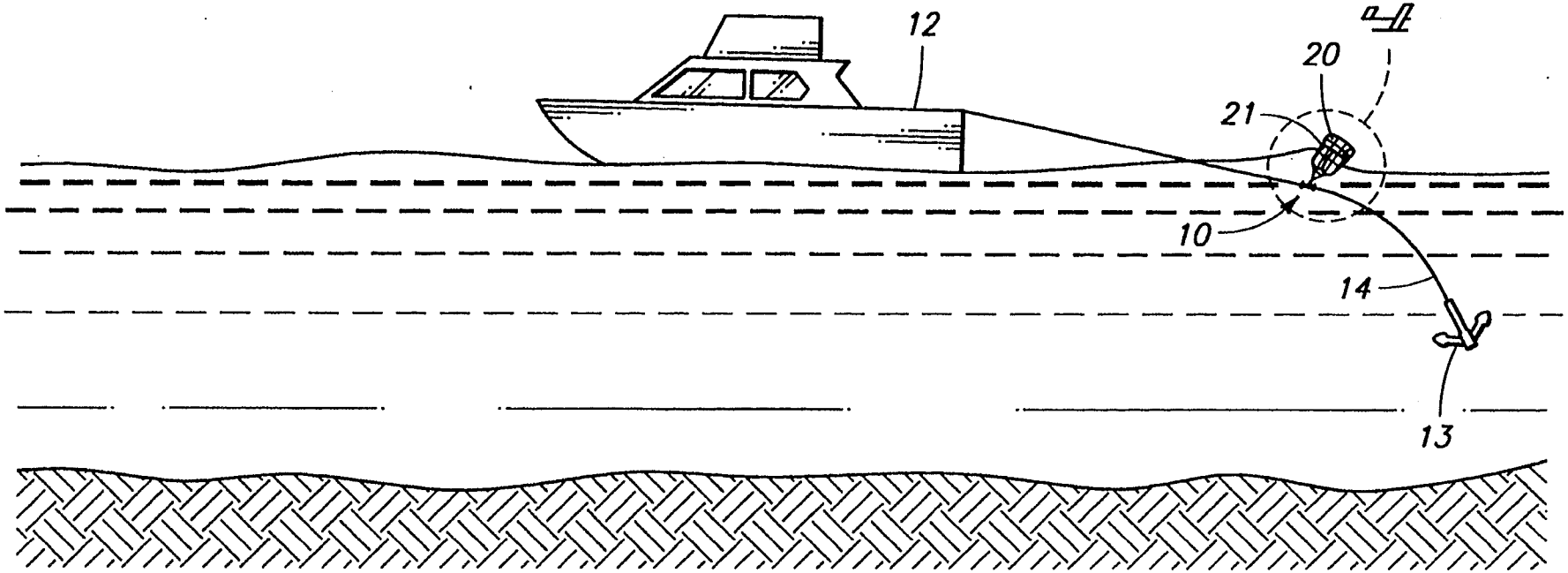
Figure 3:
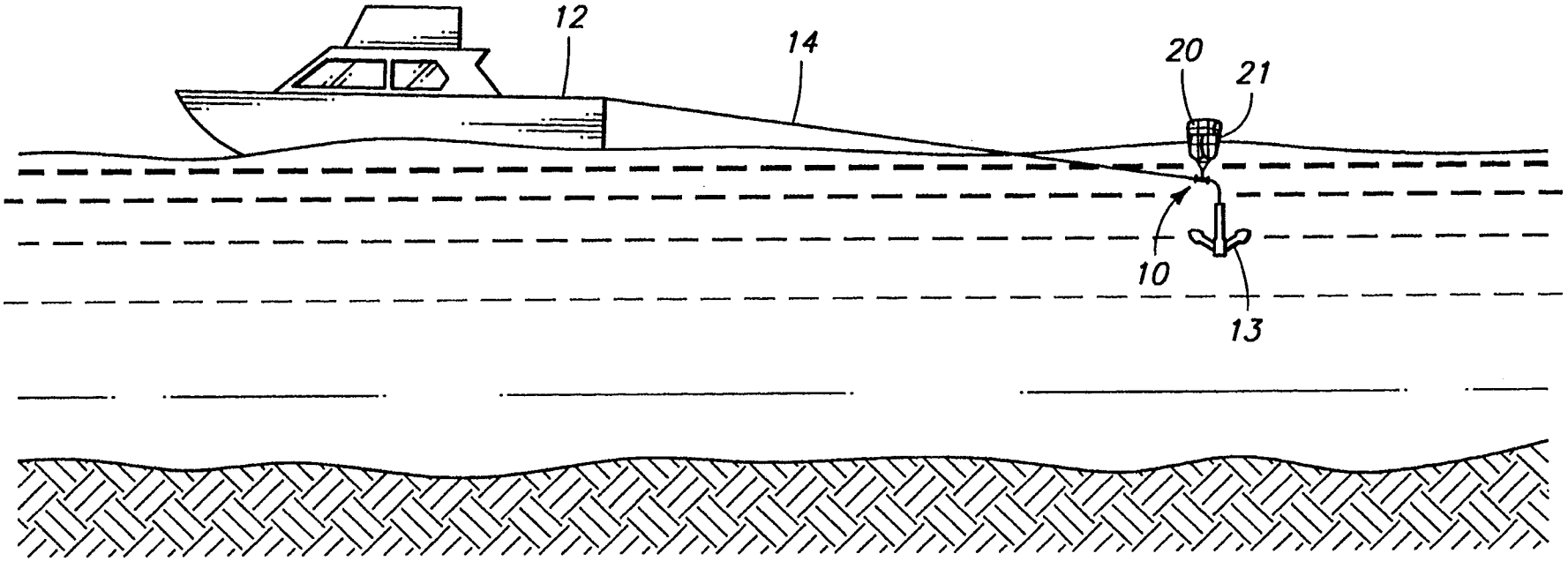

The weight 13 is shown in FIG. 1–3 as being an anchor. However, it should be understood that any form of submerged weight connectable by a rope 14 to a watercraft 12 may be acted upon by the present invention. It is expected, however, that the most prevalent use will be as shown with an anchor, in conjunction with a rope 14 and a small watercraft 12.

Figure 4:
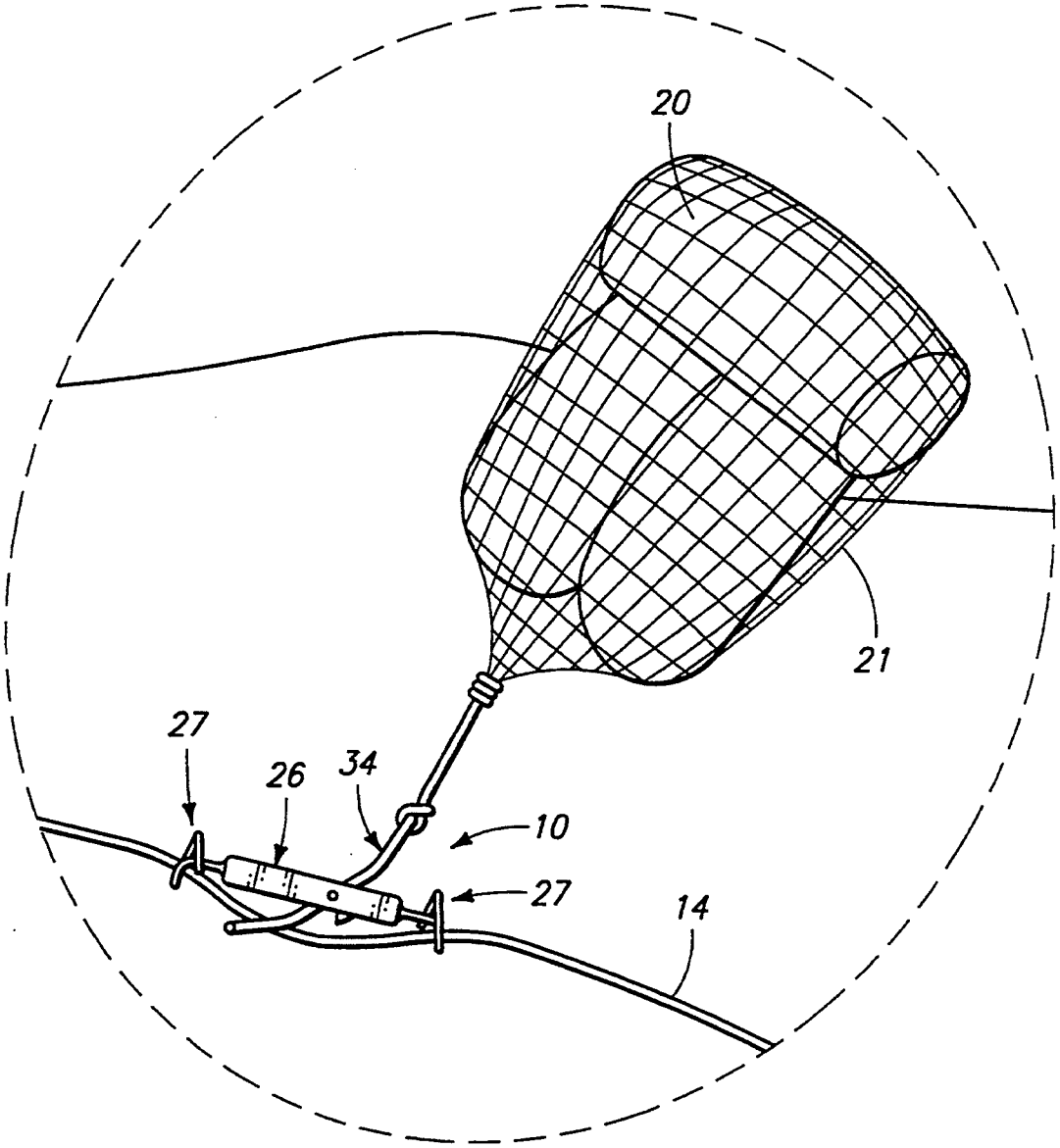
FIG. 4 is an enlarged operational view showing the present device in an unlocked position with the anchor rope sliding forwardly responsive to forward movement of the associated watercraft.

Specifics of the present retrieval device 10 are shown in FIGS. 4–10. In FIG. 4, the device is shown in conjunction with a flotation device 20. The preferred flotation device 20 includes a net bag 21 with a common draw string closure. The net bag 21 may be stuffed with a conventional flotation device such as a life vest or life ring. The net bag 21 is especially useful since it may be adapted to receive nearly any common flotation device that has sufficient buoyancy to lift the submerged weight. The surface area of the flotation device 20 will offer resistance against forward movement in the water as the watercraft 12 moves forwardly (FIG. 4).

Advantageously, the retrieval device 10 includes a rigid frame 26 which is releasably attached by a guide member 27 to rope 14. In the preferred form, the frame 26 is elongated and formed of rigid material, such as stainless steel.

Frame 26 extends between opposed forward and rearward ends 25, 28. An elongated opening 29 (FIGS. 5, 8) is defined by opposite rigid wall surfaces and ends of the frame 26, as shown in FIG. 5.

The guide member 27, preferably in the form of inward spiral bent rods 31 is provided on the frame 26 at the ends 25, 28. The spirals are open at ends of the rods 31, to allow the device to be mounted on the rope 14 at any point between the rope ends, and eliminate any need to thread the device onto a free rope end. The spiral rods 31 define a longitudinal rope receiving axis Y along the length of the frame 26.

An elongated locking member 34 is provided on the present retrieval device 10 between the frame ends 25, 28 for allowing the rope to slide through the guide member 27 in one direction (toward the craft 12) and for selectively preventing the rope from being paid out (away from the craft 12) through the guide member 27 in an opposite direction. The locking member 34 also provides connection to the flotation device 20 (FIG. 4).

Figure 5:
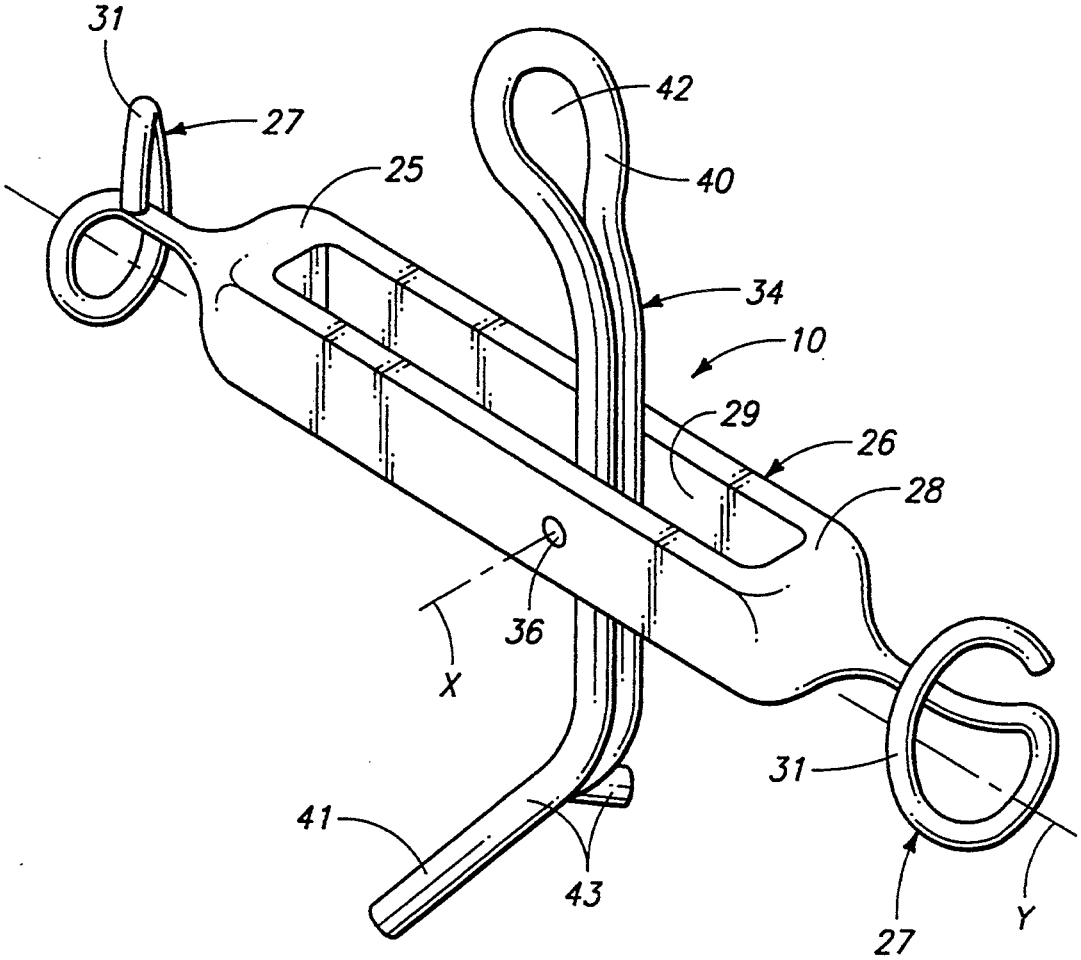
FIG. 5 is a perspective view of the present retrieval device.
Figure 6:
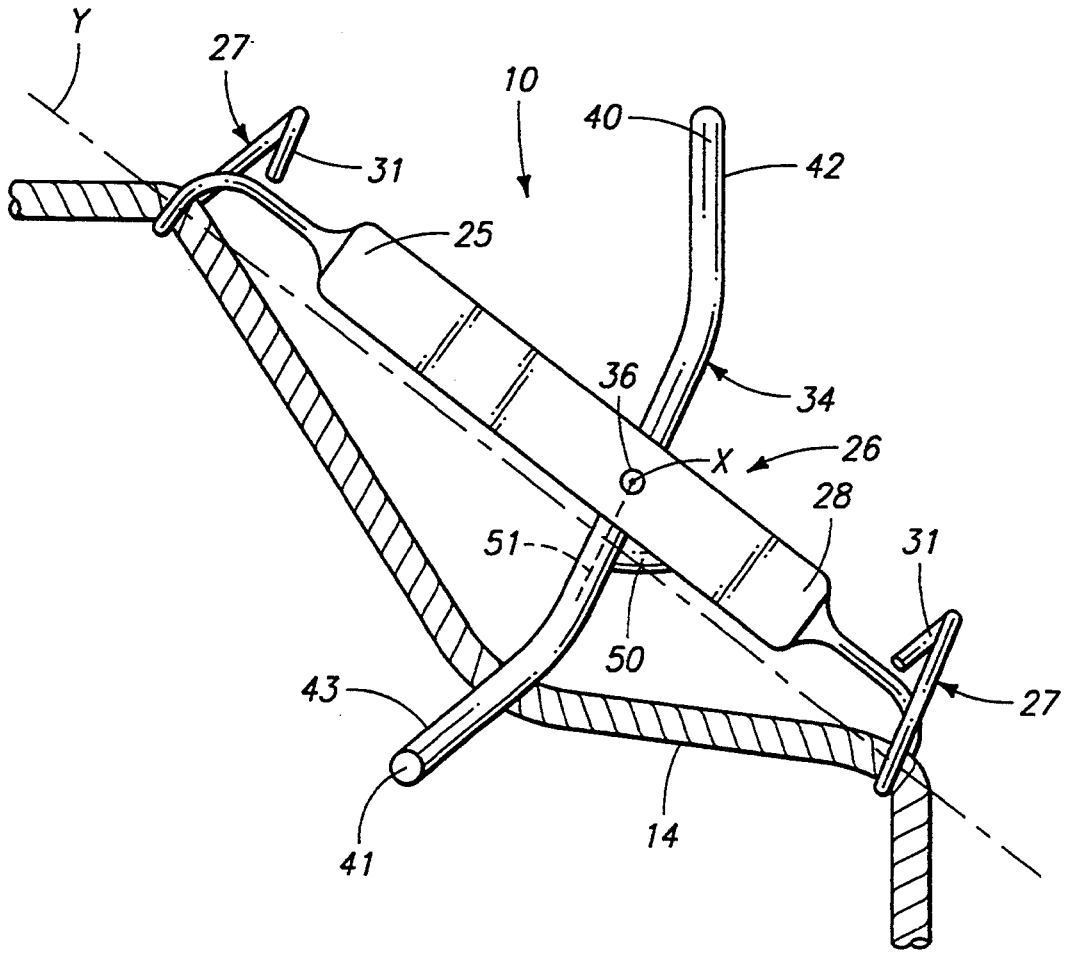
FIG. 6 is a side elevation view of the present device with a section of rope in an operative, locked position.
Figure 7:
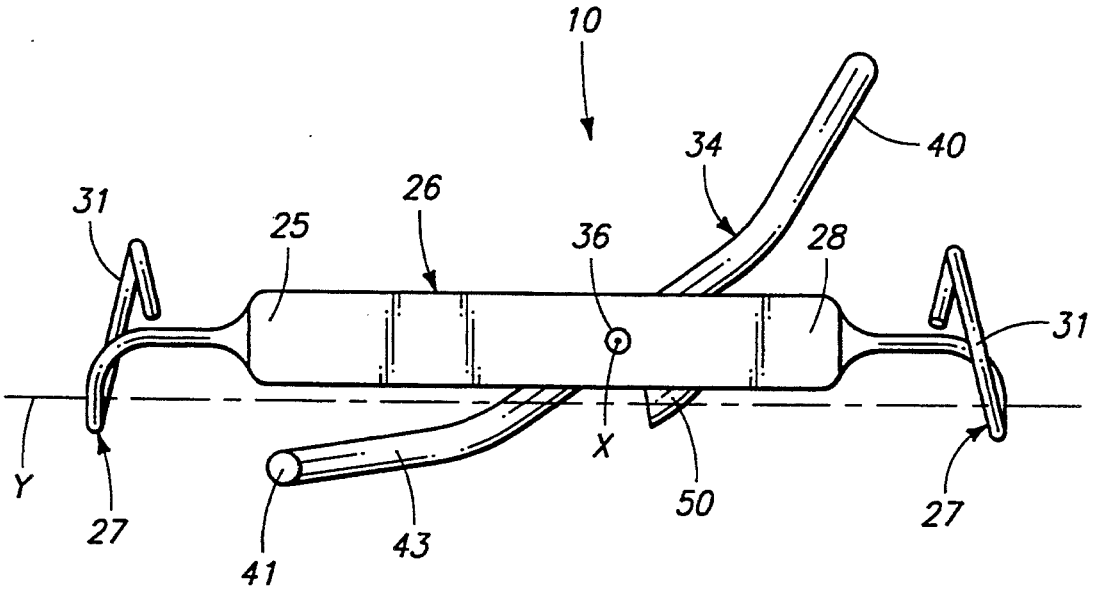
FIG. 7 is a side elevation view showing the lock member in an inoperative, unlocked position.
Figure 8:
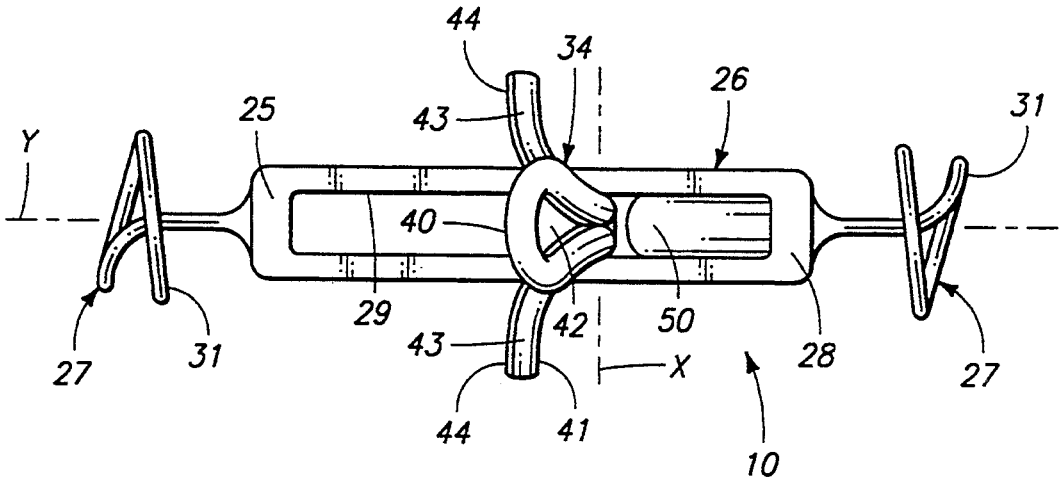
FIG. 8 is a top plan view of the present retrieval device.
Figure 9:
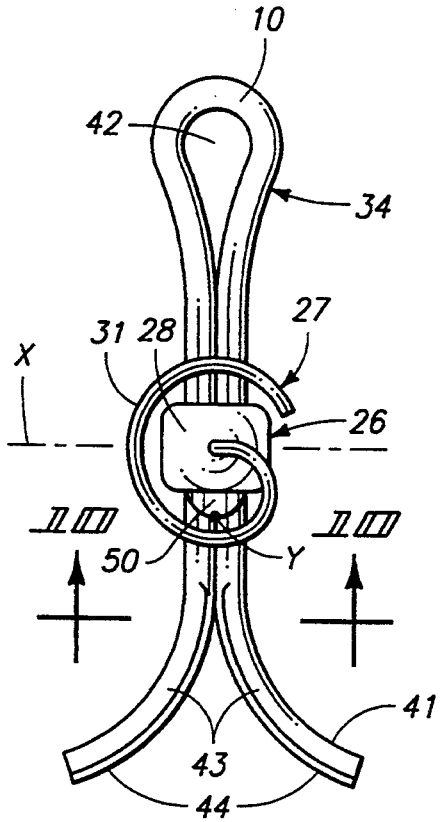
FIG. 9 is an end view of the present device.
Figure 10:
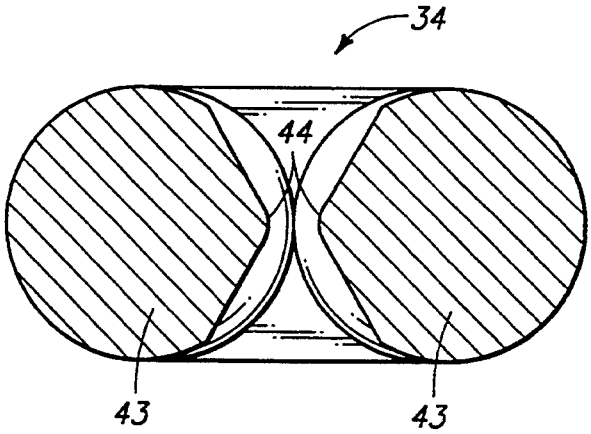
FIG. 10 is an enlarged sectional view showing the beveled gripping edges of the present device.

The locking member 34 preferably is pivoted on the frame 26 within the opening 29 by a pivot pin 36 (FIGS. 5–7). Pin 36 is situated nearly mid-way along the length of the frame 26, between the forward and rearward ends 25, 28. Pin 36 defines a locking member pivot axis X that is normal to the frame 26 and to the longitudinal rope receiving axis Y.

The locking member 34 and pin 36 are advantageously formed of a strong non-corrosive material such as stainless steel. Common casting or other appropriate conventional forming processes may be used to form both the frame 26, the guide member 27 and the locking member 34.

The locking member 34 extends above and below the frame 26, to opposite sides of the pivot pin 36. Member 34 includes a top end 40 and an opposed bottom end 41. The top end 40 is provided with a flotation connector, preferably in the form of an eyelet 42 (FIGS. 5, 8, 9), adapted to be connected to the drawstring of the flotation receiving net bag 21 (FIG. 4). In operation to retrieve the weight 13, the net and flotation device 20 holds the locking member 34 open, allowing the rope to slip through the retrieval device 10 as the watercraft moves forwardly. The weight and the flotation device then pull the locking member 34 closed when the craft is stopped, and the flotation device 20 and weight are allowed to return to a normal, depending condition (FIGS. 3, 6).

The bottom end 41 of the locking member 34 is bifurcated, with legs 43 converging to form an inverted "V" configuration. The legs 43 converge toward the top end 40 and the longitudinal rope receiving axis Y. Inwardly facing beveled rope engaging edges 44 are provided on the legs 43, as shown in detail by FIG. 10. The edges 44 are smoothly rounded, with flat sides leading tangentially into the otherwise circular periphery of the legs.

The edges 44 are used to firmly grip, but will not damage the rope when the locking member 34 is pivoted toward the rear end of the frame 26 in the operative, rope locking position (FIG. 6). This is a distinct advantage over other known gripping devices that use one moving (usually pivoted) gripping or clamp element that clamps or binds the rope against another clamp element that is stationary relative to the moving element. This places the rope filaments under strain when the clamp is closed.

The legs 43 extend to ends that are spaced apart equally from the longitudinal rope axis Y, such that the distance between the leg ends is approximately equal to half the distance between the forward and rearward frame ends 25, 28. This spacing, and the smooth arcuate curvature of the legs inwardly toward the longitudinal rope receiving axis Y encourages contact between the rope and the converging edges 44 during use.

A stop 50 is provided between the locking member 34 and the frame 26 for preventing pivotal movement of the lock member toward the rearward end of the frame beyond the operative, locking position as shown in FIG. 6. The stop 50, in the preferred form is situated on the frame 26, and is positioned in the rearward swing path of the locking member 34. The location of the stop 50 is selected so the approximate rope contact points along the edges 44 are stopped in their arcuate movement toward the rearward frame end 28 on a line 51 (FIG. 6) between the contact points and the pivot axis X that approaches a perpendicular relation to the rope receiving axis Y. Of course this angle will vary somewhat with the diameter of the rope. However, for the device to be most effective, the angle should be within a tolerance of approximately plus or minus 10° (between the line 51 and the rope receiving axis Y).

The locking member 34 swings between the operative locking position discussed above, where the rope is firmly gripped between the opposed gripping edges 44, and a forwardly pivoted inoperative position (FIGS. 4, 7), where the gripping surfaces are situated closer to the forward frame end 25. With the locking member 34 in the inoperative, open position, the rope 14 is allowed to slide in a forward direction through the device responsive to forward motion of the watercraft, as shown in FIGS. 2 and 4.

Operation of the present invention is best understood with reference to FIGS. 1–3. These figures diagrammatically illustrate use of the invention in conjunction with a submerged weight 13 in the form of an anchor. However, it is again emphasized that other weights may be used. For example, the weight could very well be a submerged fishing apparatus, such as a crab pot. In such situations, the flotation device and rope would temporarily be disconnected from the boat. The flotation device 20 would then function as a typical buoy, marking the location of the submerged weight. The steps followed to raise the weight would then be similar to those described herein for raising the anchor shown in FIGS. 1–3, except that a first step would be to pull the free end of the rope upwardly from the flotation device 20 and secure it to the watercraft.

FIG. 1 thus illustrates a beginning position for operation of the present retrieval device 10. Here, the weight 13 (anchor) has been submerged and is in contact with the bottom surface. The rope 14 leads upwardly from the anchor to the watercraft 12, where it is fastened to secure the watercraft in position.

At this time, the present device 10 may simply be loose and stored conveniently on the craft 12. To initiate use, the device 10 is mounted to the rope simply by laterally fitting the open spiral rods 31 over the rope in such a manner that the rope slides freely along the length of the frame 26 along the rope receiving axis Y. The frame 26 is fitted to the rope in such an orientation that the forward frame end 25 will face the watercraft when the device is overboard and operating, A life preserver or other flotation device 20 is stuffed into the net bag 21 and the drawstring is attached to the flotation connector eyelet 42. In order to retrieve the weight, the user simply drops the assembly overboard, (assuming the free end of the rope is attached to the watercraft) and the watercraft is started in forward motion. The craft's speed need not be excessive to produce the desired effect. In fact, it is desirable to use lower speeds as high speeds could damage the craft 12, the weight 13, or the rope 14.

As the craft progresses (FIG. 2), the flotation device will remain on or very near the surface due to its buoyancy. Its shape and mass inherently resists the forward motion of the craft 12. This resistance to motion and the buoyancy of the flotation device overcomes the tendency for the rope to pull to a straight line between the craft 12 and the submerged weight 13. A resultant upward force is produced along the rope 14 that has the effect of lifting the weight 13 from the bottom surface toward the float as the craft continues to move along. The same resistance to forward motion causes the drawstring of the net to hold the locking member 34 in the inoperative, open position (FIG. 4), thereby allowing the rope to slide freely through the guide member 27 in the forward direction.

The locking member 34 will allow free motion of the rope in this direction, but will swing back against the stop 50, gripping the rope securely between the rope engaging edges 44 when forward motion is stopped. In fact, the more rearward tension delivered along the rope from the anchor weight, the harder the rope is pulled into the converging legs of the locking member. The rope is thereby secured to the device. Thus, when the weight reaches a point where it is directly below the flotation device 20 (FIG. 3), the craft 12 may be stopped and the rope, which is now slack between the craft 12 and the retrieval device 10, may be easily pulled in.

Buoyancy of the flotation device and the locking member 34 will hold the weight in its lifted position during this time. Thus, the only exertion required on the part of the user in retracting the rope, is in pulling the flotation device toward the watercraft. This may be done with relative ease. Then, once the retrieval device 10 and weight 13 are adjacent the watercraft, the user may simply lift the flotation device 10 and weight 13 into the craft.

It can be seen that the present retrieval device affords a simple yet very effective device that facilitates raising a submerged weight by action of the associated watercraft. Thus, there is no need for additional motors or drive mechanisms, nor is there need for the operator to labor at lifting the weight completely from the bottom surface to the craft. The only physical exertion required is lifting the retrieved weight and flotation device into the craft, if desired.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. A retrieval device responsive to movement of a watercraft for lifting a submerged weight connected to the watercraft by a rope, comprising:

a flotation device;

a rigid frame extending between a forward end and a rearward end;

a guide member on the frame for releasably receiving a rope and for guiding the rope along the length of the frame;

an elongated lock member mounted to the rigid frame between the forward and rearward ends thereof, for pivotal movement about a pivot axis;

wherein the elongated lock member includes a top end and a bottom end and wherein the pivot axis is located between the top and bottom ends and the bottom end swings on the pivot axis through an arc toward and away from the forward end of the frame;

a flotation connector on the lock member at the top end thereof;

a stop between the lock member and frame for preventing pivotal movement of the lock member toward the rearward end of the frame beyond an operative, rope locking position;

wherein the lock member is bifurcated at the bottom end and includes facing, rope receiving gripping surfaces converging toward the top end of the lock member, slidably receiving the rope to allow the rope to slide in one direction toward the watercraft, and for selectively preventing the rope from being played out through the guide member in an opposite direction away from the watercraft.

2. The retrieval device of claim 1 wherein the rope receiving gripping surfaces are beveled, including beveled rope engaging edges converging in a V configuration to receive and grip the rope as the rope is moved along through the guide member toward the rearward frame end.

3. The retrieval device of claim 1 wherein the guide member is comprised of rods on the frame at the forward and rearward ends, formed in spiral configurations for slidably receiving the rope.

4. The retrieval device of claim 1 wherein the rope guide member is mounted to the rigid frame and defines a rope receiving axis that is substantially perpendicular to the pivot axis.

5. The retrieval device of claim 1 wherein the floatation device has sufficient buoyancy to support the submerged weight.

6. The retrieval device of claim 1 wherein the rope guide member is mounted to the rigid frame and defines a rope receiving axis that is substantially perpendicular to the pivot axis, and wherein the guide member is comprised of rods on the frame at the forward and rearward ends thereof, formed in spiral configurations for slidably receiving the rope along the rope receiving axis.

7. The retrieval device of claim 1 wherein the flotation device includes a net for releasably receiving a buoyant device.

8. The retrieval device of claim 1 wherein the rope guide member is mounted to the rigid frame and defines a rope receiving axis that is substantially perpendicular to and intersecting the pivot axis, and wherein the trope receiving and gripping surfaces are offset to one side of the rope receiving axis from the top end of the lock member.

9. A retrieval device responsive to movement of a watercraft for connection to a flotation device to lift a submerged weight connected to the watercraft by a rope, comprising:

a rigid frame extending between a forward end and a rearward end;

a guide member on the frame with lateral openings for releasably receiving a rope and for slidably guiding the rope along the length of the frame;

an elongated lock member mounted to the rigid frame between the forward and rearward ends thereof, for pivotal movement about a pivot axis transverse to the frame;

wherein the elongated lock member includes a top end and a bottom end and wherein the pivot axis is located between the top and bottom ends and the bottom end swings on the pivot axis through an arc toward and away from the forward end of the frame;

a stop between the lock member and frame for preventing pivotal movement of the lock member toward the rearward end of the frame beyond an operative, rope locking position;

wherein the lock member is bifurcated at the bottom end and includes facing, rope receiving gripping surfaces converging toward the top end of the lock member, slidably receiving the rope to allow the rope to slide in one direction toward the watercraft, and for selectively preventing the rope from being played out through the guide member in an opposite direction away from the watercraft.

10. The retrieval device of claim 9 wherein the rope guide member is mounted to the rigid frame and defines a rope receiving axis that is substantially perpendicular to and intersecting the pivot axis, and wherein the rope receiving and gripping surfaces are offset to one side of the rope receiving axis from the top end of the lock member.

11. The retrieval device of claim 9 wherein the rope guide member is mounted to the rigid frame and defines a rope receiving axis that is substantially perpendicular to the pivot axis, and wherein the guide member is comprised of rods on the frame at the forward and rearward ends thereof, formed in spiral configurations for slidably receiving the rope along the rope receiving axis.

12. The retrieval device of claim 9 wherein the guide member is comprised of rods on the frame at the forward and rearward ends, formed in spiral configurations for slidably receiving the rope.

13. The retrieval device of claim 9 wherein the rope receiving gripping surfaces are beveled, including beveled rope engaging edges converging in a V configuration to receive and grip the rope as the rope is moved along through the guide member toward the rearward frame end.

14. The retrieval device of claim 9 wherein the rope guide member is mounted to the rigid frame and defines a rope receiving axis that is substantially perpendicular to the pivot axis, and wherein the rope receiving gripping surfaces include beveled rope engaging edges converging in a V configuration toward the rope receiving axis to receive and grip the rope as the rope is moved along through the guide member toward the rearward frame end.

* * * * *